United States Patent [19]

Sheridon et al.

[11] 4,021,236

[45] May 3, 1977

[54] IMAGING SYSTEM

[75] Inventors: Nicholas K. Sheridon, Saratoga, Calif.; Dorian Kermisch, Penfield, N.Y.

[73] Assignee: Xerox Corporation, Stamford, Conn.

[22] Filed: Apr. 24, 1975

[21] Appl. No.: 571,199

[52] U.S. Cl. ..... 96/1.5; 96/1.1

[51] Int. Cl.[2] ..... G03G 5/028

[58] Field of Search ..... 96/1.1, 1.5, 1 R

[56] References Cited

UNITED STATES PATENTS

| | | | |
|---|---|---|---|
| 3,063,872 | 11/1962 | Boldebuck | 96/1.1 |
| 3,515,880 | 6/1970 | Letter | 96/1.5 |
| 3,716,359 | 2/1973 | Sheridan | 96/1.1 |
| 3,764,311 | 10/1973 | Bean | 96/1.1 |

*Primary Examiner*—John D. Welsh

*Attorney, Agent, or Firm*—James J. Ralabate; Richard A. Tomlin; John H. Faro

[57] ABSTRACT

A deformation imaging system including an imaging member comprising a layer of a surface deformable material, a layer of an elastomer material, and means for establishing an imagewise electrical field across at least the surface deformable material layer and/or the elastomer layer. Embodiments wherein the surface deformable material layer and the elastomer layer are adjacent each other and embodiments wherein these layers are separated from each other are described. Various techniques for subjecting the imaging members to an electrical field and imaging methods utilizing the imaging members are also disclosed.

31 Claims, 8 Drawing Figures

IMAGING SYSTEM

CROSS-REFERENCE TO RELATED CASES

Reference is made to copending applications Ser. Nos. 571,323 and 571,198, both filed on even date herewith.

BACKGROUND OF THE INVENTION

This invention relates generally to deformation imaging and more particularly to a deformation imaging system including an imaging member comprising a layer of a surface deformable material and a layer of elastomer material.

There is known in the deformation imaging art a class of imaging members which utilizes surface deformable imaging materials such as thermoplastic resin materials. Such imaging members are used in deformation imaging methods such as Frost deformation imaging, relief deformation imaging and variations of Frost and relief deformation imaging wherein an optical screen is used to modulate the image information. Generally, in both Frost and relief deformation imaging, an imaging member comprising a layer of a suitable surface deformable material and including photoconductive insulating material, either in the form of a separate layer or incorporated in the surface deformable material layer, is electrostatically charged such as with a corona charging device, exposed to an imagewise pattern of activating electromagnetic radiation, (optionally charged a second time in the case of Frost deformation imaging) and then developed by softening the surface deformable material layer such as by heating. An imagewise deformation pattern corresponding to the image input is formed in the layer surface deformable material and this image may be read out by projection either in transmission or reflection. Typically the images formed in Frost and relief deformation imaging members are permanent images, i.e, they will be retained indefinitely in the member. Also, both Frost and relief imaging members can typically be recycled many times, that is, old images may be erased such as by softening the surface deformable imaging material and new images recorded therein according to the well known methods. Because of these characteristics as well as other desirable properties, these imaging members are advantageous for use in many imaging applications.

However, Frost and relief deformation imaging members have not proved to be completely satisfactory when used in a recyclable mode. Typically, it has been found that each succeeding image recorded in these members is somewhat inferior in quality to its predecessor and the number of imaging cycles for which the numbers will provide acceptable results is limited. These characteristics may be attributable to residual memory effects in the surface deformable material which cause some memory of the previous images to be retained and to contamination of the deformable surface by the permanent accumulation of dust which is acquired during the charging step and permanently affixed during the subsequent softening of the material during development. It would be desirable to extend the recycling capability of imaging members which include a layer of a surface deformable material.

There is also known in the imaging art a broad class of imaging members which record optical images by an imagewise distribution of photogenerated voltages or currents acting upon a voltage or current-alterable recording medium. Typically, in these members, imagewise activating radiation incident on a photoconductor allows charge carriers to move in an electric field. These charge carriers interact with a voltage or current sensitive member which in turn modulates light. Sheridon has disclosed the Ruticon (derived from the Greek words "rutis" for wrinkle and "icon" for image) family of imaging members wherein a voltage-sensitive, light modulating recording medium comprises a deformable elastomer layer and the photoconductive material may be provided as a separate layer or incorporated in the elastomer layer. (For a detailed description of the Ruticon devices see *IEEE Transactions on Electron Devices*, September 1972 and U.S. Pat. No. 3,716,359.) Various different embodiments for establishing an electric field across the elastomer layer are described. Generally, imaging is effected by establishing an electrical field across the elastomer layer and exposing the imaging members to an imagewise pattern of activating electromagnetic radiation. An imagewise deformation pattern corresponding to the image input information is formed in the layer of elastomer material and the image may be read out by projection such as with a Schlieren optical system. Ruticon imaging members are capable of providing excellent images over a great number of imaging cycles and are advantageous for use in many applications such as, for example, image intensification, etc. Moreover, these members may also be used for buffer storage of images since the images formed typically remain for some period of time after exposure is completed. This image storage capability is limited though, since the images typically erase because of various effects which cause the contrast potential across the elastomer layer to diminish or disappear. It would be desirable to extend the image storage time of imaging members which include a layer of elastomer material.

SUMMARY OF THE INVENTION

It is, therefore, an object of this invention to provide the above noted desirable features.

It is a further object of the invention to provide a novel deformation imaging system.

It is still another object of this invention to provide imaging members which are capable of permanently storing images.

Another object is to provide an imaging system wherein a plurality of images may be formed in an imaging member.

It is another object to provide an imaging system wherein permanent and variable images may be formed on an imaging member.

Still further it is an object of the invention to provide imaging members which may be used in a recyclable mode.

It is yet another object of the invention to provide imaging members including a layer of surface deformable material and a layer of an elastomer material.

Another object of the invention is to provide imaging members including photoconductive insulating material.

It is a further object of the invention to provide an imaging system wherein an imaging member is imaged by a matrix address sytsem.

It is another object of the invention to provide an imaging system wherein an imaging member is imaged by an electron beam address system.

It is still another object to provide imaging methods utilizing the novel imaging members of the invention.

BRIEF SUMMARY OF THE INVENTION

These and other objects and advantages are accomplished in accordance with the invention by providing an imaging sytem including an imaging member comprising a layer of a surface deformable material, a layer of an elastomer material, and means for establishing an imagewise electrical field across at least the surfae deformable material layer and/or the elastomer layer. Generally, the imaging members of the invention are imaged by establishing an imagewise electrical field across the surface deformable material layer and/or the elastomer layer, softening the surface deformable material, such as by ohmic heating, until it deforms and subsequently allowing the surface deformable material to cool whereby the surface deformable material layer and the elastomer layer permanently deform in an imagewise pattern corresponding to the imagewise electrical field. The imaged member may be read out with transmission or reflection optical systems employing a Schlieren optical system. The imaging member may be used in a recyclable mode by erasing the previously formed image by softening the surface deformable material until a smooth surface deformable material layer is formed and then re-imaging the member in the above-described manner.

In one embodiment the surface deformable material layer and the elastomer layer are disposed adjacent to each other on the imaging member and in another embodiment these layers are separated from each other. These respective embodiments of the imaging members provided according to the invention possess different capabilities and may be used in different applications as will be discussed in detail below herein. According to a preferred embodiment of the invention, an imaging member further includes photoconductive insulating material, either incorporated in the surface deformable material layer or the elastomer layer or in the form of a separate layer or the elastomer layer field which effects imaging is provided by establishing a uniform electrical field across the surface deformable material layer and/or the elastomer layer and exposing the imaging member to an imagewise pattern or activating electromagnetic radiation. In other embodiments of the invention the imagewise electrical field is provided by other techniques such as by a matrix address system or an electron beam scanning system.

BRIEF DESCRIPTION OF THE DRAWINGS

For a better understanding of the invention as well as other objects and further features thereof, reference is made to the following detailed description of various preferred embodiments thereof, taken in conjunction with the accompanying drawings wherein.

DESCRIPTION OF THE PREFERRED EMBODIMENTS

Figure 1:
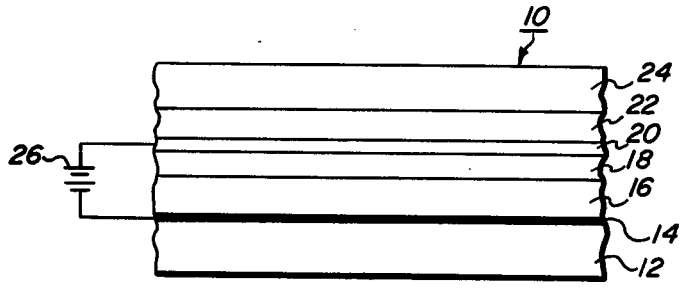
FIG. 1 is a partially schematic cross-sectional view of an embodiment of an electroded imaging member wherein one electrode comprises a flexible conductive metallic layer.

In FIG. 1 there is shown in partially schematic cross-sectional view an imaging member, generally designated 10, wherein a substantially transparent support substrate 12 and substantially transparent conductive layer 14 comprise a substantially transparent electrode. It should be noted that the electrode need not be transparent; it may be opaque depending upon how imaging member 10 is used. Overlying conductive layer 14 is photoconducting insulating layer 16 which in turn carries surface deformable material layer 18. In another embodiment the photoconductive insulating material may be incorporated in the surface deformable material layer 18 thus obviating the need for layer 16. Overlying surface deformable material layer 18 is a thin flexible conductive metallic layer 20 which serves as a second electrode for the imaging member 10. Overlying layer 20 is a deformable elastomer layer 22 which has arranged over it optional window layer 24. Window layer 24, which tyically comprises glass, protects elastomer layer 22 from contamination such as from dust and restrains the upper surface of the elastomer layer from deforming to follow the deformations of layer 18 thus forcing the elastomer to deform in such a way that it exerts a maximum restoring force thereby decreasing the recycling time of the member. The window layer also suppresses interference effects which may occur during readout if the upper surface of elastomer layer 22 is not prevented from deforming and its presence can have an effect upon the spatial frequency recording capability of the member. Accordingly, it is preferred to include window layer 24 in the member. The electrodes are connected to potential source 26 which may be A.C., D.C., or a combination thereof. The external electrical circuit may also include suitable switching means (not shown).

In operation of the imaging device 10, an electrical field is established across photoconductive layer 16 and surface deformable material layer 18 by applying a potential from source 26 to the electrodes. With the electrical field on the imaging member is exposed to an imagewise pattern of activating electromagnetic radiation. The electrical field induces a flow of charge in the regions of the photoconductive layer 16 which are exposed to the radiation thus varying the strength of the field across surface deformable material layer 18. The mechanical force of the electrical field will cause the surface deformable material to deform with accompanying deformation of flexible conductive metallic layer 20 when the surface deformable material is sufficiently softened. It should be noted here that the amplitude of the deformation depends, inter alia, upon the spatial frequency of the mechanical force. The softening of the surface deformable material may be effected by heat generated by passing an electrical current through layer 14 for that purpose. It will be appreciated by those skilled in the art that various electrode configurations for providing this result are possible. The ohmic heating step may be carried out prior to, simultaneous with or after the imaging and electrical field application steps. While softening of the surface deformable layer by ohmic heating is preferred it should be noted that the layer may be softened by any suitable technique. Since heating could in some cases have a deleterious effect upon the properties of the photoconductive material it is preferred to use surface deformable materials which soften at a temperature which is well below the temperature at which the photoconductive material may be damaged. It is noted that photoconductive materials such as various alloys of selenium and poly-n-vinylcarbazole doped with Brilliant Green dye or 2,4,7-trinitro-9-fluorenone can withstand relatively high temperatures without being adversely affected and thus constitute preferred materials for use in the imaging members.

The elastomer layer 22 will follow deformation of layers 18 and 20. Upon cooling the deformation of the surface deformable material layer-flexible conductive metallic layer interface will constitute a permanent image record. When it is desired to erase the image, the surface deformable material is again heated thus allowing the shear forces of the elastomer to again form a smooth surface deformable layer-metallic layer surface. It will be appreciated that the activating electromagnetic radiation must reach photoconductive insulating layer 16. Where flexible conductive metallic layer 20 is opaque, the support substrate 12 and conductive layer 14 must be at least substantially transparent to allow the image information to reach photoconductive layer 16. In this instance, image information may be read out continuously of the readout light is incident from above imaging member 10. If metallic layer 20 is transparent, imaging member 10 may be read out in transillumination provided substrate 12, conductive layer 14 and photoconductive layer 16 are all at least quasi-transparent to the readout illumination and provided that layers 18 and 22 have different indices of refraction or window layer 24 is not used.

Many advantages accrue to a fully electroded device such as that illustrated in FIG. 1. It will be appreciated that the use of the elastomer layer 22 and the flexible conductive metallic layer 20 in conjunction with surface deformable material layer 18 allow the imaging member to possess the permanent image retention capability which is characteristic of surface deformable materials but without the disadvantage of corona charging. Because the member is fully electroded the surface of the surface deformable material is protected from air during deformation and is not subjected to the damaging effects of corona charging (a problem with prior art deformation imaging members utilizing such surface deformable materials). This typically increases the useful number of imaging cycles the member is capable of before memory or previously recorded images becomes a problem. Further, the imagewise deformation in prior art thermoplastic surface deformable material members is dependent upon the electrostatic force produced by the photoconductor, upon the temperature to which the thermoplastic material is raised and upon the period of time the thermoplastic material is maintained at that temperature. The imagewise deformation of the elastomer material is dependent only upon the electrostatic force produced by the photoconductor (of course, the deformation of both thermoplastic and elastomeric layers is also dependent upon the spatial frequency content of the imagewise electrostatic forces). Thus, the net effect of using both elastomer layer 22 and surface deformable layer 18 in imaging member 10 is that deformation cannot proceed until the surface deformable material is softened, but when the deformation does begin the extent of the deformation is then controlled by the elastomer. This feature removes the constraint that typically exists for good image quality with members including thermoplastic layers, namely, that the surface of the thermoplastic layer must be exposed to only a carefully controlled amount of heat. According to the imaging members of the present invention, any amount of heating ranging from enough to soften the surface deformable material to enough to damage the member or discharge the photoconductor, should typically produce images of comparable quality.

The use of the elastomer-flexible metallic layer combination provides the imaging member 10 with a high reflectivity metal coating for more efficient readout yet allows it to be capable of undergoing extensive image cycles. Typically, reflective metallic layers deposited on surface deformable material layers are destroyed after a few imaging cycles. Since both the elastomer material and the surface deformable material have refractive indices greater than air, light passing through either layer to reach and reflect from the metallic layer 20 will undergo greater modulation (and hence produce greater image brightness) for a given deformation than would be the case for reflection of the light at an airmetallic layer interface. The reason for this is that for the same magnitude of surface deformation, the optical path changes are proportional to the refraction index of the medium adjacent to the surface. In the Ruticon embodiment wherein a flexible conductive metallic electrode is utilized, a layer of an insulating liquid is placed on the metallic layer to obtain this effect (see U.S. Pat. No. 3,716,359); however, in the prior art imaging devices which used thermoplastic layers such a technique has typically not been possible because of the necessity to access the thermoplastic layer for corona charging. Additionally, the imaging members of the invention should typically be erasable more quickly than prior art thermoplastic devices because the restoring forces exerted by the elastomer for image erasure typically are much greater than those exerted by the softened thermoplastic.

As aforesaid, the bottom electrode of the imaging member 10 may comprise any suitable conductive material and may be transparent or opaque. The electrode may be a single layer of conductive material or it may comprise, as illustrated in FIG. 1, a transparent conductive layer arranged on a suitable support substrate such as, for example, glass or plastic materials. Typical suitable transparent conductive layers include continuously conductive coatings of conductors such as tin, indium oxide, aluminum, chromium, tin oxide or any other suitable conductors. These substantially transparent conductive coatings are typically evaporated or sputtered onto the more insulating transparent substrate. NESA glass, a tin oxide coated glass manufactured by the Pittsburgh Plate Glass Company, is a commercially available example of a typical transparent conductive layer coated over a transparent substrate.

Any typical suitable photoconductive insulating material may be used for layer 16. Typical suitable photoconductive insulating materials include, for example, selenium, poly-n-vinylcarbazole (PVK), poly-n-vinylcarbazole doped with sensitizers such as Brilliant Green Dye, phthalocyanine, and 2,4,7-trinitro-9-fluorenone (TNF); cadmium sulfide, cadmium selenide; zinc oxide, sulfur, anthracene, and tellurium. Additionally, photoconductive layer 16 may comprise a finely ground photoconductive insulating material dispersed in a high resistance electrical binder such as is disclosed in U.S. Pat. No. 3,121,006 to Middleton et al, or an inorganic photoconductive insulating material such as is disclosed in U.S. Pat. No. 3,121,006 to Middleton et al, or an organic photoconductor such as phthalocyanine in a binder. Generally, any photoconductive insulating material or composition may be used for layer 16.

The thickness of the photoconductive layer 16 is typically in the range of from about 0.1 microns to about 200 microns or more; the thickness of the layer in any particular instance depends, inter alia, largely upon the spatial frequency of the information to be recorded. Photoconductive layer 16 may be formed on substrate 14 by any of the many methods which are well-known to those skilled in the art including, for example, vacuum evaporation, dip coating from a solution, etc. It is again noted that the photoconductive material may be included in surface deformable layer 18 thus obviating the need for layer 16.

Any typical suitable surface deformable material may be used for layer 18. Layer 18 may comprise, for example, any suitable electrically insulating thermoplastic resin capable of being softened at a moderate temperature. While the surface deformable material may conveniently be a solid at room temperature and temporarily softenable by heating it may also comprise a material which is viscous at room temperature, for example, having a viscosity of about $10^5$ poises at room temperature but which can be solidified by cooling when required. The surface deformable layer may also comprise a material which hardens or polymerizes upon heating (in this case the image would be permanently formed). Piccolastic A-50 and Piccotex-100 resins available from Pennsylvania Industrial Chemical Corp., Staybelite Ester 10 available from Hercules Powder Co. and Velsicol Chemical Corp., are preferred surface deformable materials because of their suitable deformable and insulating properties and because of their high transparency. Many other materials are suitable for forming layer 18. Table I below is a partial list of typical suitable materials.

| | Trademark | Chemical Type | Manufacturer |
|---|---|---|---|
| (1) | Piccotex | Styrene | Pennsylvania Industrial Chemical Corp. |
| (2) | Piccolyte | Terpene Resin | " |
| (3) | Staybelite 5 | Rosin Ester | Hercules Powder Co. |
| (4) | Staybelite 10 | Rosin Ester | " |
| (5) | Piccoumaron | Coumarone | Pennsylvania Industrial Chemical Corp. |
| (6) | Piccolastic D150 | Styrene | " |
| (7) | Piccoflex 100A | Polyvinyl Chloride | Pennsylvania Industrial Chemical Corp. |
| (8) | Neville R13 | Coumarone indene | Neville Chemical Co. |
| (9) | Neville Soft | Phenol modified coumarone indene | " |
| (10) | Piccolastic E125 | Styrene | Pennsylvania Industrial Chemical Corp. |
| (11) | Piccolastic D125 | Styrene | " |
| (12) | Picco 75 | Indene | " |
| (13) | Piccopale H-2 | Hydrocarbon (unsaturated) | " |
| (14) | Piccolastic A-50 | Styrene | " |
| (15) | Piccolastic A-75 | Styrene | " |

Generally, layer 18 may have a thickness of from about 0.1 microns to about 100 microns or more and preferably from about 0.5 micron to about 10 microns. The surface deformable material generally should be a reasonably good insulator and typically have a volume resistivity above about $10^4$ ohm-cm. Preferably the material will have a volume resistivity above about $10^{12}$ ohm-cm. It is noted that the spatial frequency response of the member is primarily determined by the thickness and resistivity of surface deformable layer 18. In a member having a peak response at 40 *l*p/mm, layer 18 would preferably have a thickness of about 6 microns and a resistivity of from about $10^8$ ohm-cm to $10^{18}$ ohm-cm with $10^{14}$ ohm-cm being adequate for most purposes.

According to the invention there may be provided imaging members wherein the images formed are permanent or erasable. When it is desired to utilize the imaging member in the permanent image mode the surface deformable material may be any of many suitable materials including, for example, epoxy resins, thermosetting resins and the like. These materials would be allowed to harden irreversibly after the elastomer layer had reached an imagewise deformation. In the case of erasable imaging members the surface deformable material may be a heat softenable material such as a thermoplastic resin, or a wax such as, for example, paraffin, carnauba, beeswax, ceresin, and the like. Suitable types of greases may even be used in layer 18 to provide greatly extended image storage.

Flexible conductive metallic layer 20 must be sufficiently flexible to follow the deformations in the surface deformable material and elastomer layers. In addition, metallic layer 20 desirably should be highly reflective, have good lateral conductivity, possess excellent stability, exhibit little internal stress and be highly adherent to either one or both of layers 18 and 22. Any suitable conductive material which possesses the requisite flexibility and conductivity characteristics when deposited in the form of a thin layer may be used to form layer 20. Preferred compositions for layer 20 comprise gold-indium, chrome-silver and titanium-silver.

Since layer 20 is typically opaque, then substrate 12 and conductive layer 14 are preferably transparent in order to allow image information to reach photoconductive layer 16. Of course, additional materials may be added to the metallic layer 20 in order to enhance or suppress particular characteristics such as, for example, to enhance spectral reflectivity, suppress light scattering or reduce internal stresses. The thickness of flexible metallic layer 20 is typically in the range of from about 100 angstroms to about several thousand angstroms depending, inter alia, upon the desired flexibility and the requisite conductivity. In the instance where optical isolation between the readin and readout illumination is desired (i.e., where the image information is read in through the substrate and the imaged member is read out in reflection) an optical density of about 6 is typically preferred for flexible metallic layer 20. When lower or higher optical density is required the layer can be made thicker or thinner. Where isolation between the readin and readout illumination is not required then flexible metallic layers having an optical density of about 2 would typically be satisfactory. The opacity required of layer 20 in any instance may be reduced by incorporating a dye in surface deformable layer 18. Organic thermoplastic materials which may be used in layer 18 typically accept dye well.

Flexible metallic layer 20 may be formed by various techniques including by chemical reaction, precipitation from a solution, electrophoresis, electrolysis, electroless plating, vapor deposition and others. It is preferred to form this layer by vapor deposition. For a preferred technique for forming flexible metallic layers which contain two different metals see U.S. Pat. No. 3,716,359.

Deformable elastomer layer 22 may comprise any suitable elastomer material. The term "elastomer" in the various forms used herein is defined as a usually amorphous material which exhibits a restoring force in response to a deformation, that is, an amorphous material which deforms under a force and because of volume and surface forces, tends to return to the form it had before the force was applied. Typical suitable elastomeric soft solid materials for use in the imaging devices of the invention include both natural (such as natural rubber) and synthetic polymers which have rubber-like characteristics, i.e., are elastic, and include materials such as styrene-butadiene, poly-butadiene, neoprene, butyl, polyisoprene, nitrile, urethane and ethylene rubbers. A preferred class of elastomer materials includes water based gelatin gels and dimethylpolysiloxane gels. The elastomers generally should be reasonably good insulators and typically have volume resistivities above about $10^4$ ohm-cm and shear moduli of from about 10 to about $10^8$ dynes/cm$^2$ and dielectric strengths above about 10 volts/mil. Preferably, the elastomers will have volume resistivities above about $10^{12}$ ohm-cm, shear moduli of from about $10^5$ to about $10^7$ dynes/cm$^2$ and dielectric strengths greater than about 500 volts/mil. Commercially available elastomers which have been found to be suitable for use include: Sylgard 182, Sylgard 184, Sylgard 188 (available from Dow Corning Co.). RTV 602 and RTV 615 (available from General Electric Co.). It is noted here that in the embodiment illustrated in FIG. 1 the electrical properties of the elastomer material are not of primary importance. These properties are of importance in other embodiments according to the invention. The higher volume resistivity elastomers are preferred for some applications since in those instances they typically provide extended image storage capability. Elastomers having relatively high dielectric strength are preferred in some instances because they typically allow the members to be operated at relatively high voltage levels which is desirable.

A particularly preferred elastomer is a transparent, very compliant composition which comprises an elastomeric dimethylpolysiloxane gel made by steps including combining about one part by weight of Dow Corning No. 182 silicone resin potting compound, about 0.1 part by weight of curing agent and anywhere from about zero to about thirty parts by weight of Dow Corning No. 200 dimethylpolysiloxane silicone oil. Other suitable resins include transparent flexible organosiloxane resins of the type described in U.S. Pat. No. 3,284,406 in which a major portion of the organic groups attached to silicon are methyl radicals.

The thickness of elastomer layer 22 is typically in the range of from about 0.1 microns to about 2000 microns depending, inter alia, upon the spatial frequency of the information to be recorded. Various optical properties of the imaging member may be enhanced by a suitable selection of the elastic modulus of the particular elastomer material used. For example, a relatively more stiff elastomer will typically recover more rapidly from an image when the electric field is removed and thus may be erased more quickly. On the other hand, an elastomer material having a relatively low elastic modulus is typically capable of greater deformations and hence greater optical modulation for a given value of electric field. The elastomer material may be coated on the photoconductor layer 16 as a monomer and polymerized in situ or it may be coated on the photoconductor surface from solutions in volatile solvents which will evaporate and leave a thin uniform layer. The elastomer layer may also be formed by spin coating techniques.

In the embodiment illustrated in FIG. 1, surface deformable layer 18 is typically thinner than elastomer layer 22 because the thickness of the former, as aforesaid, is largely determinative of the spatial frequency response of the member and hence must be relatively thin. Elastomer layer 22 may be any thickness greater than layer 18. Generally, with respect to all of the embodiments possible according to the invention, the relative thicknesses of the surface deformable material and elastomer layers are dependent upon a number of variables including, for example, which layer drives the deformation, the properties of the materials used, the compliance of the flexible metallic layer, the spatial frequency range of interest, whether a window layer is present, etc.

Potential source 26 may be A.C., D.C. or a combination thereof. The external electrical circuit may also include suitable switching means (not shown). Voltages in the range of from about 20 to about 100 volts/micron of thickness of layer 18 are typically used for imaging.

Figure 2:
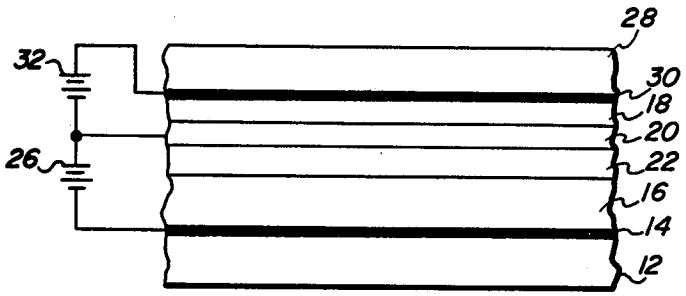
FIG. 2 is a partially schematic cross-sectional view of another embodiment of an electroded imaging member wherein one electrode comprises a flexible conductive metallic layer.

In FIG. 2 there is illustrated another embodiment of an imaging members according to the invention. This embodiment is similar to that shown in FIG. 1 with the exception that the surface deformable layer 18 and elastomer layer 22 have their positions reversed, an additional electrode, illustrated here as comprising a substantially transparent substrate 28 and a substantially conductive layer 30 is provided in place of window layer 24 and an additional power supply 32 is included. In operation of this embodiment an electrical field is established between the bottom electrode and flexible conductive metallic layer 20 by applying a potential from source 26 and the photoconductive layer is exposed to an imagewise pattern of activating radiation. In this mode, there is formed across elastomer layer 22 an imagewise electrical field the mechanical force of which will cause the elastomer to deform with accompanying deformation of flexible conductive metallic layer 20. The role of the surface deformable material layer in this embodiment is to maintain the deformation of the elastomer and flexible metallic layers in the absence of the electrical field. Surface deformable material layer 18 can be softened by any suitable technique. Preferably this is done by heating the layer by passing an electrical current through conductive layer 30 by means of power source 32. As aforesaid, the heating step may be carried out prior to, simultaneous with, or after the imaging and electrical field application steps.

It is noted that, in general the image deformation layers in the embodiments shown in FIGS. 1 and 2 (the surface deformable layer 18 in FIG. 1 and the elastomer layer 22 in FIG. 2 will be thinner than the other deformable layers above them (the elastomer layer 22 in FIG. 1 and the surface deformable material layer 18 in FIG. 2; however, these latter layers must be capable of adequate deformations in response to the deformations of the image deformation layers.

In the embodiment illustrated in FIG. 2 the presence of the second potential source 32 provides an advantage in that it provides an additional mechanical force to act upon the flexible metallic layer 20. This additional force will be uniform and will not take part in the imaging until the metallic layer begins to deform. Upon deformation of the metallic layer the uniform mechanical force provided by potential source 32 increases the amplitude of the deformation and tends to maintain the deformation.

Figure 3:
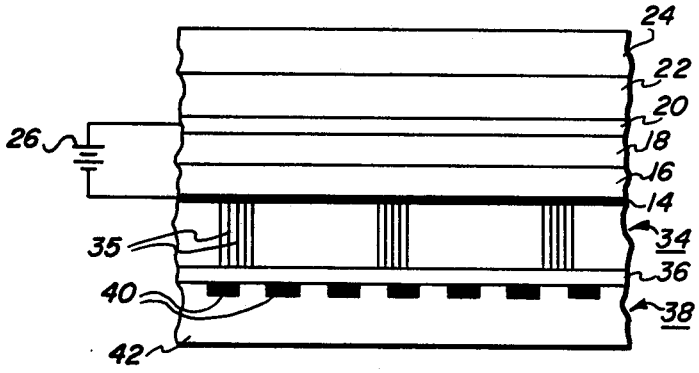
FIG. 3 is a partially schematic cross-sectional view of an imaging member according to the invention which includes a fiber optic element and a spatial light modulating element.

It should be noted here that other elements besides those shown in FIGS. 1 and 2 may be incorporated in the imaging members of the invention. According to a preferred embodiment of the invention images having spatial frequencies substantially lower than the resonant deformation frequencies of the elastomer or the surface deformable material can be recorded by including an absorption type line grating between the projected light image and the photoconductor upon which it is imaged. For the imaging members of the invention the screen may be located immediately adjacent the photoconductive layer. Other types of screens which may be similarly located are described in U.S. Pat. Nos. 3,698,893 and 3,719,483. The image deformation layer will deform along the pattern of the high spatial frequency screen in those areas where it is illuminated. The image obtained by illuminating the imaged member will thus have a fine structure of lines superimposed upon the original object that was recorded. If this line structure is objectionable it may be removed by suitable optical filtering techniques which are well known in the art. Of course, the spatial light modulating means may be included in any of the various embodiments of the imaging members provided according to the invention. In a preferred embodiment, a fiber optic element may be used to optically carry an image of the spatial light modulating means and incident image information to an image plane where they are processed according to the invention and an image is formed. This embodiment is illustrated in FIG. 3 and is generally the same as the embodiment of FIG. 1 with the exception that substrate 12 is not present and there is included fiber optic element, generally designated 34, optional index matching liquid layer 36 and spatial light modulating element 38 shown here as a series of lines of light absorbing or reflecting material 40 residing on a clear transparent substrate 42 which may be glass. Fiber optic element 34 comprises a plurality of light conducting optical fibers 35 (some of which are shown for purposes of illustration) secured together in side by side relation so that corresponding opposite ends of the fibers cooperate to define first and second faces. In operation, an imagewise pattern of activating electromagnetic radiation is focused at the plane between the spatial light modulating element and the bottom surface of the fiber optic element whereby an image of the spatial light modulating element and the image information are optically carried to the conductive layer 14-photoconductive layer 18 interface by the fiber optic element. Thus, the spatial light modulating element is, in effect, allowed to perform its function as though it were located at that interface. Moreover, spatial light modulating element 28 can be disposed so as to be easily removed from the imaging member. Hence, in the event the remainder of the imaging member may be rendered incapable of further use the spatial light modulating element can be removed therefrom and used again in another imaging member. Also, the capabilities of any imaging member may be varied merely by changing the particular type of spatial light modulating element incorporated therein. Any suitable fiber optic element may be used and these may have a variety of shapes including planar, concave, convex, conical, etc.

It will be seen that the fiber optic element, because of the plurality of individual fibers included therein, is itself capable of modulating the image information. However, it is preferred to have the image information modulated by the spatial light modulation means and consequently it is preferred that the size of the fibers be much smaller than the periodicity of the light modulation means to minimize possible destructive optical effects which might otherwise occur. Spatial light modulation means 38 may be any suitable element such as a Ronchi ruling which is an absorption type line grating having alternating strips, generally equal in width, of light absorbing, or reflecting, and light transmitting areas; or a color grating. The light modulation means may have any periodicity. For the deformable layers typically used in imaging member 10 a grating having a periodicity of 40 *l*p/mm or 100 *l*p/mm is used. It should be noted that the lifetime of the imaging member typically may be extended by rotating the spatial light modulation means between exposure cycles or series of cycles.

Arranged between spatial light modulation means 38 and fiber optic element 34 is optional index matching liquid layer 36 which does away with any air gap which would cause resolution losses and which would typically be present unless special precautions were taken such as, for example, using pressure to force the fiber optic element into intimate contact with the spatial light modulating element. Accordingly, the use of layer 36 constitutes a preferred embodiment. Layer 36 is chosen so as to have an index of refraction which is relatively close or equal to that of the grating substrate (typically glass) and the glass of the fiber optic bundles (typically about 1.5–1.75). Layer 36 generally has a thickness which is far less than the periodicity of the grating (for example, a 40 *l*p/mm grating has a period of 25 microns) and preferably is as thin as possible, for example, about 0.1 to about 2 microns. Generally, any suitable liquid which has an appropriate index of refraction may be used in layer 36. Typical suitable liquids include, for example, alcohols, oils such as 200 Dielectric Fluid available from Dow Corning, water, soaps such as glycerine, and index matching liquids available from Cargille Lab., Inc., Cedar Grove, New Jersey. Generally, layer 36 is from about 0.1 to about 10 microns thick.

In other embodiments, the imaging members of the invention do not include any photoconductive material and the imagewise electrical field is established across the appropriate image deformation layer by other techniques such as, for example, by means of an electron beam address system or an electrical X-Y matrix address system.

Figure 4:
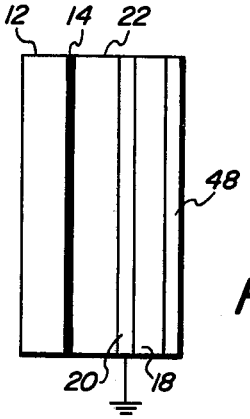
FIG. 4 is a partially schematic cross-sectional view of an imaging member according to the invention which is imaged by electron beam address.

FIG. 4 illustrates an imaging member according to the invention wherein an electron beam address system is used to image the member. Layer 48 comprises an electron attenuating material such as, for example, glass, mylar, mica, etc. In operation an electron beam is scanned across the surface of the member from the right. Wherever charge is deposited, the grounded flexible metallic layer 20 and hence, the elastomer layer 22-surface deformable layer 18 interface will deform if the surface deformable layer is softened. Electron attenuating material layer 48 is typically thinner than the deformable layers and serves as protection for the surface deformable material layer.

The imaging members of the invention may be used in various applications including, for example, long term storage of information, optional short term storage or long term storage, etc. In one embodiment an ultraviolet light hardenable material may be used as the surface deformable material so that certain image information could be permanently recorded on the imaging member and would appear on all reproductions made from the imaging member. The permanently recorded image information could be a form such as a bank statement or a questionnaire and would be imaged onto the member by ultraviolet light. Other areas of the surface deformable material would remain unaffected and could be subsequently softened to allow deformation thereof along with the elastomer layer to record imagery for short term storage. Accordingly, variable information could be reproduced together with the standard form in a cyclic mode without requiring repeated exposure of the imaging member to the form. In this embodiment, typically the surface deformable material layer would be adjacent the elastomer layer. Alternatively, an ultraviolet light hardenable elastomer material such as Sylgard 182 could be utilized in the member.

Figure 5:
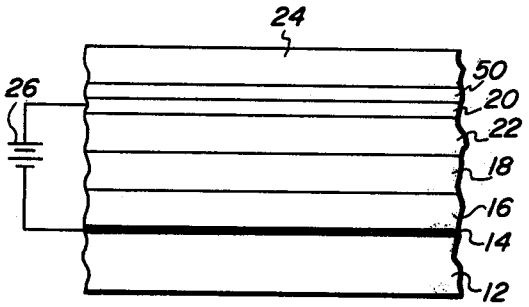
FIG. 5 is a partially schematic cross-sectional view of an embodiment of an imaging member wherein the surface deformable material layer and the elastomer layer are adjacent each other.

In FIG. 5 there is illustrated an embodiment of an imaging member according to the invention wherein the elastomer layer and the surface deformable material layer are adjacent one another. In this embodiment flexible conductive metallic layer 20 is positioned above the surface deformable material layer 18 and the elastomer layer 22. In operation an electrical field is established between the electrodes by applying a potential from source 26. With the electrical field on the imaging member is exposed to an imagewise pattern of activating electromagnetic radiation which may be spatially modulated as previously described. It should be noted that flexible metallic layer 20 may or may not be present when the upper surface of the member is charged by means of a corona charging device. Layer 20 is preferably included in the member as are optional insulating liquid layer 50 and window layer 24. As is known in the art, light passing through insulating liquid layer 50 and reflecting from metallic layer 20 undergoes more modulation than would be the case for reflection of the light at an air-metallic layer interface and hence produces greater image brightness for a given deformation. When the imaging member is subjected to the electrical field and imagewise exposure the elastomer layer will deform (as will flexible metallic layer 20 when it is present) in imagewise configuration. The deformations in the elastomer layer may be maintained for a period of time by maintaining the electrical field after exposure is completed. Thus, relatively short term image storage is obtained. Where long term storage of the image is desired the surface deformable material layer may be softened such as by passing current through conductive layer 14. The softened material will follow the deformations in the elastomer layer and upon cooling a permanent image is obtained since the deformations in the elastomer will be maintained by the deformations in layer 18. In the embodiments where a permanent image is recorded in the imaging member the elastomer layer may continue to be used for further image recording in the short term storage mode. Hence, it is seen that the imaging member may be utilized by exploiting only the properties of the elastomer layer or by exploiting the properties of both the elastomer and surface deformable material layers.

As described above, the member may be used to combine variable information with constant information (a blank form, etc.) in a real time cyclic mode. The member illustrated in FIG. 5 may also conveniently be used in holographic interferometry. In such a technique the normal condition of an object which is being studied could be recorded in the imaging member in permanent fashion using a deformed surface deformable material layer as described above. As the object becomes altered with time the short term storage mode of the device could then be used as described above to provide a display of interference fringes which depict the magnitude of change of the object.

Figure 6:
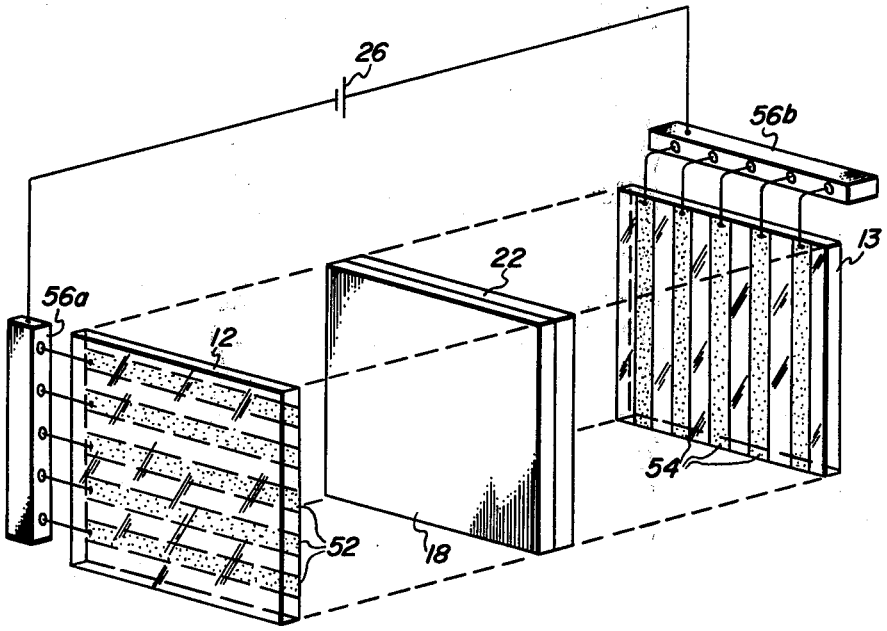
FIG. 6 is a partially schematic cross-sectional view of an embodiment of an imaging member which is imaged by an electrical X-Y matrix address system.

FIG. 6 illustrates an imaging member according to the invention wherein an electrical X-Y matrix address system is used to sequentially or simultaneously apply an electrical field across selected areas of the member. The deformable layers 18 and 22 are sandwiched between a pair of transparent electrodes. The front transparent electrode comprises transparent support substrate 12 upon which strips of substantially transparent conductive material 52 are coated. The rear electrode comprises substrate 13, which may be transparent or opaque, upon which are coated strips of conductive material 54 which may be transparent or opaque. The electrodes are arranged so that conductive strips 52 and 54 on the respective electrodes cross each other in an X-Y matrix grid. Each conductive strip in each set of parallel strips 52 and 54 is electrically connected to a circuit system 56 which is suitable for selective or sequential operation. Through selection systems **56*a* and 56*b* and an external circuit including potential source 26, an electrical field for creating a deformation image in the imaging member according to the invention can be established across selected points or a selected sequence of points. It is noted that conductive strips 52 and 54** may vary in width from a very fine wire-like configuration to any desired width.

Although the electrical X-Y matrix address system has been illustrated with respect to its use in a specific imaging member, it should be noted that such an address system may be used in conjunction with the other imaging members described herein. For example, in the embodiment illustrated in FIG. 1 conductive layer 20 may be provided in the form of a plurality of conductive strips overcoated with a reflective dielectric material layer (or multiple layers). Layer 14 could be provided in the form of a plurality of conductive strips which are arranged orthogonally to the other conductive strips. Of course, in such an embodiment photoconductive layer 16 would not be required and a suitable electrical circuit system for selective or sequential operation would be provided.

Figure 7:
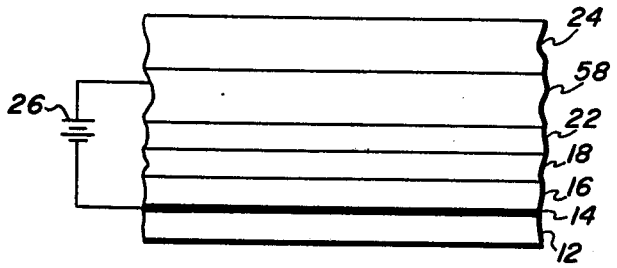
FIG. 7 is a partially schematic cross-sectional view of an embodiment of an imaging member wherein one electrode comprises a layer of a conductive fluid.

In FIG. 7 there is shown another embodiment of an imaging member according to the invention wherein a relatively thick layer of a conductive fluid 58 comprises one of the electrodes. In this embodiment surface deformable material layer 18 and elastomer layer 22 may be arranged as illustrated or may have their positions reversed. The relatively thick conductive fluid layer 58 may or may not be transparent. Typical suitable nontransparent conductive fluids include, for example, mercury, room temperature molten gallium-indium alloys, etc. Transparent conductive fluids include water to which conductive impurities have been added. Where the fluid is transparent it should preferably have a substantially different refractive index than the elastomer so that the deformations in the elastomer surface will phase modulate the illuminating light. The imaging member may be used in the transmission readout mode or the reflection readout mode where the fluid is transparent. The reflections may be enhanced by placing a thin flexible transparent layer over elastomer layer 22 having a substantially different refractive index than either the elastomer or the transparent conductive fluid. Window layer 24, as previously described, could be of normal optical property glass and contains the conductive fluid against elastomer layer 22. It should be noted that most conductive transparent fluids typically will undergo electrolysis in a D.C. electrical field which is undesirable because it leads to a deterioration of the operating components of the apparatus as well as the evolution of gas. Accordingly, operation with conductive transparent fluids is preferably carried out with the use of an A.C. electrical field.

In another embodiment surface deformable material layer 18 is not required. The conductive fluid may be provided at a temperature slightly above its melting point and after imaging has been effected the material allowed to cool below the melting point thus allowing it to solidify and in this manner permanently recording the image. Conductive fluid layer may be of any thickness greater than about 0.1 micron.

Figure 8:
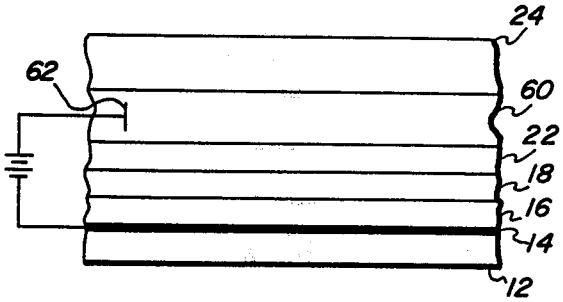
FIG. 8 is a partially schematic cross-sectional view of an embodiment of an imaging member wherein one electrode comprises a layer of a conductive gas.

FIG. 8 illustrates another embodiment of an imaging member according to the invention. This embodiment is essentially identical to that shown in FIG. 7 except that the conductive fluid layer 58 in FIG. 7 is replaced by a conductive gas 60 and requires an electrode 62 which may be a transparent conducting window. The conductive gas in the cavity may be obtained by means of a glow discharge through a low pressure gas of a few millimeters of mercury pressure, or by means of a low pressure arc discharge which commonly takes place at a few microns of mercury pressure. The gas may also be ionized by means of intense radioactivity in or near low pressure gas 60 ar radio frequency excitation of the gas in the cavity or other techniques for producing a conductive gaseous plasma which are well known in the art. Charging of the surface of the elastomer layer 22 may also take place if the gas 60 is at a sufficiently high vacuum and contains a source of thermally excited electrons such as a heated tungsten filament which is directed against the surface of the elastomer layer. This may be a scanned or unscanned beam or it may be from a multiplicity of electron emitting sources. A reflective layer may also be placed over layer 22 at the interface between layers 22 and 60. Conductive gas layer 60 is typically from about 0.1 micron thick to an indefinite thickness. Electrode 62 may be a separate electrode or may be coupled to a transparent conducting window to contain the conductive gas against elastomer layer 22. The container for keeping the conductive gas from escaping would, of course, have to be airtight to contain the gas at the necessary vacuum.

Although the invention has been described with respect to various preferred embodiments thereof it is not intended to be limited thereto but rather those skilled in the art will recognize that variations and modifications may be made therein which are within the spirit of the invention and the scope of the claims.

What is claimed is:

1. An imaging system comprising an imaging member having a flexible conductive metallic layer arranged between a layer of a thermoplastic material having a volume resistivity above about $10^4$ ohm-cm and a layer of elastomer material having a volume resistivity above about $10^4$ ohm-cm; means for establishing an imagewise electrical field across one of said thermoplastic layer or said elastomer layer; and means for softening said thermoplastic layer.

2. The imaging system as defined in claim 1 wherein said means for establishing an imagewise electrical field includes a layer of photoconductive insulating material on a transparent conductive substrate and said imaging system includes a source of potential coupled to said substrate and said conductive material layer.

3. The imaging system as defined in claim 2 and further including spatial light modulating means.

4. The imaging system as defined in claim 1 wherein said flexible conductive layer has an optical density of about 6.

5. The imaging system as defined in claim 1 wherein said flexible conductive layer comprises gold and indium.

6. The imaging system as defined in claim 1 wherein said thermoplastic material and said elastomer material each has a volume resistivity above about $10^{12}$ ohm-cm.

7. The imaging system as defined in claim 6 wherein said means for establishing an imagewise electrical field includes a photoconductive insulating layer on a transparent conductive substrate, wherein said surface deformable material layer is adjacent said photoconductive layer and further including a window layer overlying said elastomer layer and a source of potential coupled to said conductive substrate and said flexible conductive material layer.

8. The imaging system as defined in claim 7 and further including spatial light modulating means.

9. The imaging system as defined in claim 6 wherein said means for establishing an imagewise electrical field includes a photoconductive insulating layer on a transparent conductive substrate, wherein said elastomer layer is adjacent said photoconductive layer and further including a window layer overlying said thermoplastic layer and a source of potential coupled to said transparent conductive substrate and said flexible conductive material layer.

10. The imaging system as defined in claim 9 and further including spatial light modulating means.

11. The imaging system as defined in claim 6 wherein said means for establishing an imagewise electrical field includes a photoconductive insulating layer on a transparent conductive substrate, wherein said thermoplastic layer is adjacent said photoconductive layer and further including a transparent conductive overlayer overlying said elastomer layer, a first source of potential coupled to said transparent conductive substrate and said flexible conductive material layer and a second source of potential coupled to said transparent conductive overlayer and said flexible conductive material layer.

12. The system as defined in claim 11 and further including spatial light modulating means.

13. The imaging system as defined in claim 6 wherein said means for establishing an imagewise electrical field includes a photoconductive insulating layer on a transparent conductive substrate, wherein said elastomer layer is adjacent said photoconductive layer and further including a transparent conductive overlayer overlying said elastomer layer, a first source of potential coupled to said transparent conductive substrate and said flexible conductive material layer and a second source of potential coupled to said flexible conductive material layer and a second source of potential coupled to said transparent conductive overlayer and said flexible conductive material layer.

14. The imaging system as defined in claim 13 and further including spatial light modulating means.

15. The imaging system as defined in claim 1 wherein said means for establishing an imagewise electrical field comprises an electrical X-Y matrix address system.

16. An imaging method comprising the steps of a. providing an imaging system according to claim 1;
b. establishing an imagewise field across one of said thermoplastic layer or said elastomer layer;
c. softening said thermoplastic layer until an image is formed; and
d. hardening said thermoplastic layer whereby said image is retained in said member.

17. The method as defined in claim 16 and further including the step of optically reconstructing the image formed in said imaging member.

18. The method as defined in claim 17 and further including erasing the image formed in said member by steps including softening said surface deformable material.

19. The method as defined in claim 16 wherein step (b) is carried out by means of an electron beam address system.

20. The method as defined in claim 16 wherein step (b) is carried out by means of an electrical X-Y matrix address system.

21. The method as defined in claim 16 wherein said layer of thermoplastic material and said layer of elastomer material each has a volume resistivity above about $10^{12}$ ohm-cm.

22. The method as defined in claim 21 wherein said means for establishing an imagewise electrical field includes a photoconductive insulating layer on a transparent conductive substrate, wherein said thermoplastic layer is adjacent said photoconductive layer and said imaging member includes a window layer overlying said elastomer layer and a source of potential coupled to said conductive substrate and said flexible conductive layer; and step (b) includes applying a potential difference between said conductive substrate and said flexible conductive layer and exposing said photoconductive layer to an imagewise pattern of activating electromagnetic radiation.

23. The method as defined in claim 22 and further including spatially modulating said imagewise pattern of activating electromagnetic radiation.

24. The imaging method as defined in claim 21 wherein said means for establishing an imagewise electrical field includes a photoconductive insulating layer on a transparent conductive substrate, wherein said elastomer layer is adjacent said photoconductive layer and said imaging system includes a window layer overlying thermoplastic layer and a source of potential coupled to said transparent substrate and said flexible conductive material layer; and step (b) includes applying a potential difference between said conductive substrate and said flexible conductive material layer and exposing said photoconductive layer to an imagewise pattern of activating electromagnetic radiation.

25. The method as defined in claim 24 and further including spatially modulating said imagewise pattern of activating electromagnetic radiation.

26. An imaging member comprising a. a deformable component having (i) a flexible conductive metallic layer arranged between and contiguous with (ii) a layer of thermoplastic material having a volume resistivity above about $10^4$ ohm-centimeters and (iii) a layer of elastomer material having a volume resistivity above about $10^4$ ohm-centimeters;
b. a layer of photoconductive material contiguous with either the layer of thermoplastic material or the layer of elastomer material; and
c. a pair of electrodes, one of which is contiguous with the free surface of the layer of photoconductive material and the other being contiguous with the free surface of the deformable component.

27. The imaging member of claim 26, wherein at least one of the pair of electrodes is substantially transparent.

28. An imaging member comprising a. a deformable component having (i) a layer of elastomer material having a volume resistivity of about $10^4$ ohm-centimeters arranged between and contiguous with (ii) a layer of thermoplastic material having a volume resistivity above about $10^4$ ohm-centimeters and (iii) a flexible conductive metallic layer;
b. a layer of photoconductive material contiguous with the surface of the layer of thermoplastic material; and
c. an electrode contiguous with the free surface of the layer of photoconductive material.

29. The imaging member of claim 28 having a layer of insulating liquid contiguous with the flexible conductive metallic layer.

30. The imaging member of claim 29 having a window layer contiguous with the layer of insulating layer.

31. An imaging member comprising a. a deformable component having (i) a layer of elastomer material having a volume resistivity of about $10^4$ ohm-centimeters arranged between and contiguous with (ii) a layer of thermoplastic material having a volume resistivity above about $10^4$ ohm-centimeters and (iii) a flexible conductive metallic layer;

b. a layer of photoconductive material contiguous with the surface of the layer of thermoplastic material;

c. an electrode contiguous with the free surface of the layer of photoconductive material; and d. a cavity which is defined in part by the free surface of the layer of elastomer material, said cavity containing an ionizable gas or material which is capable of producing a conductive gaseous plasma.

* * * * *